US009511600B2

(12) United States Patent
Terauchi et al.

(10) Patent No.: US 9,511,600 B2
(45) Date of Patent: Dec. 6, 2016

(54) THERMAL TRANSFER PRINTER

(75) Inventors: Shuhei Terauchi, Tokyo (JP); Tomoyuki Takeshita, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 0 days.

(21) Appl. No.: 13/593,333

(22) Filed: Aug. 23, 2012

(65) Prior Publication Data

US 2013/0182059 A1 Jul. 18, 2013

(30) Foreign Application Priority Data

Jan. 16, 2012 (JP) ..... 2012-005842

(51) Int. Cl.
*B41J 2/325* (2006.01)

(52) U.S. Cl.
CPC ..... *B41J 2/325* (2013.01)

(58) Field of Classification Search
USPC ..... 347/171
See application file for complete search history.

(56) References Cited

U.S. PATENT DOCUMENTS

| | | | | |
|---|---|---|---|---|
| 6,146,035 | A * | 11/2000 | Ishigouoka et al. | 400/621 |
| 6,206,589 | B1 | 3/2001 | Bjork et al. | |
| 6,259,824 | B1 * | 7/2001 | Sekiya | 382/274 |
| 6,356,292 | B1 * | 3/2002 | Sawano | 347/251 |
| 6,453,133 | B1 * | 9/2002 | Osari et al. | 399/82 |
| 6,742,858 | B2 * | 6/2004 | Lehmkuhl et al. | 347/24 |
| 7,556,445 | B2 * | 7/2009 | Takahashi et al. | 400/120.01 |
| 7,701,609 | B2 * | 4/2010 | Yoshida | 358/1.5 |
| 7,717,632 | B2 * | 5/2010 | Lien et al. | 400/120.17 |
| 8,317,421 | B2 * | 11/2012 | McNestry | 400/234 |
| 8,459,766 | B2 * | 6/2013 | Shinohara et al. | 347/9 |
| 2002/0054201 | A1 * | 5/2002 | Takeda et al. | 347/221 |
| 2004/0174424 | A1 * | 9/2004 | Burdenko | B41J 2/335 347/197 |
| 2009/0309949 | A1 | 12/2009 | Fukutani et al. | |
| 2011/0030569 | A1 | 2/2011 | Boudreau et al. | |

FOREIGN PATENT DOCUMENTS

| | | | |
|---|---|---|---|
| EP | 1 900 537 | A1 | 3/2008 |
| JP | 1-171869 | A | 7/1989 |
| JP | 2001-199091 | A | 7/2001 |
| JP | 2004-82334 | A | 3/2004 |
| JP | 2006-51693 | A | 2/2006 |
| JP | 2007-90798 | A | 4/2007 |
| JP | 2007090798 | A * | 4/2007 |
| JP | 2007-196575 | A | 8/2007 |
| JP | 2008-114451 | A | 5/2008 |
| JP | 2009-234085 | A | 10/2009 |
| JP | 4843830 | B2 | 12/2011 |
| TW | 2011-06822 | A1 | 2/2011 |

* cited by examiner

*Primary Examiner* — Matthew Luu
*Assistant Examiner* — Lily Kemathe
(74) *Attorney, Agent, or Firm* — Birch, Stewart, Kolasch & Birch, LLP.

(57) ABSTRACT

A thermal transfer printer is capable of printing a plurality of images from one picture block of an ink sheet. The thermal transfer printer includes a damage prediction part that makes prediction of damage on a subsequent print image to be generated by printing of a preceding image by predicting damage on the ink sheet to be generated by printing of the preceding image, and a print control part that prints the preceding image while exerting control to suppress generation of the predicted damage on the subsequent print image based on the damage prediction.

6 Claims, 7 Drawing Sheets

THERMAL TRANSFER PRINTER

BACKGROUND OF THE INVENTION

Field of the Invention

The present invention relates to a thermal transfer printer and more specifically, to a thermal transfer printer capable of printing a plurality of images from one picture block of an ink sheet.

Description of the Background Art

Generally, a thermal transfer printer transfers ink in each line of an ink sheet onto a sheet of paper by conveying the ink sheet and the sheet of paper contacting each other under pressure between a thermal head and a platen roller, and at the same time, by controlling generation of heat in the thermal head. Generally, images of three color components including Y (yellow), M (magenta) and C (cyan) are placed one above the other and transferred, and thereafter, an OP (overcoat) layer is transferred, thereby enhancing resistance to whether and resistance to fingerprints of a printed matter.

Regarding a thermal transfer printer is for use in printing of photographs, it is assumed that an existing ink sheet has a large size covering a sum of the sizes of a plurality of images. In this case, use of an ink sheet of a small size corresponding to the minimum size required for printing of each image is preferred. This however involves initial costs required for preparation of a die to form a cylinder for new ink sheets, and management costs in response to the increased number of types of ink sheets. Application of the existing ink sheet reduces these costs so that it acts quite advantageously in terms of costs. So, according to a known technique, a plurality of images is printed by using a large-sized ink sheet (see for example Japanese Patent Application Laid-Open No. 2007-90798).

For printing of first and second images, for example, each color component of the first image is transferred to print the first image. Next, in order to find the beginning of each color component of the second image, an ink sheet having a region not having been used for printing is rewound. Then, the second image is printed by using the region not having been used for printing.

If a dye-sublimation printer prints an image of a high density or makes prints at high speed, excessive thermal energy is applied to an ink sheet per unit area. The ink sheet is made of a very thin base material. So, in response to application of thermal energy, the base material of the ink sheet is seriously damaged which may lead to shrinkage thereof. The base material of the ink sheet shrinks at a rate that varies in response to the magnitude of thermal energy. So, if the ink sheet is rewound to find a region not having been used for printing, damage on the ink sheet generated during printing of a preceding image may adversely affect printing of a subsequent image. By way of example, a printing crease may be formed or the ink sheet may fracture during printing of the subsequent image. This adverse effect becomes noticeable especially if a plurality of images is formed by using a large-sized ink sheet.

The aforementioned problem may be solved by printing means disclosed in Japanese Patent Application Laid-Open No. 2007-90798. This printing means determines damage generated on an ink sheet by printing of a preceding image based on the average of the gradations of the density of the preceding image, and thereafter prints a subsequent image.

The printing means suggested in Japanese Patent Application Laid-Open No. 2007-90798 changes a position of an ink sheet to be used based on the density of a print image, thereby reducing the probability of fracture of the ink sheet and maintaining the efficiency of print time during printing of a plurality of images by using a large-sized ink sheet. However, this may complicate a print sequence. As an example, when the ink sheet being used is reattached to a printer, a used region of the reattached ink sheet should be specified in order to determine a position of the ink sheet to be used.

Japanese Patent Application Laid-Open No. 2007-90798 further suggests means for determining damage generated on the ink sheet by printing of a preceding image. If this means determines that the ink sheet is seriously damaged, a damaged picture block of the ink sheet is not used by rewinding the ink sheet, but other part of the ink sheet is used for printing. However, this technique may make part of the ink sheet left unused become useless, generating a fear of increase of operational costs.

SUMMARY OF THE INVENTION

It is an object of the present invention to provide a thermal transfer printer that reduces damage on an ink sheet, making it possible to suppress generation of a printing crease in a surface of a printed matter due to damage on the ink sheet.

The thermal transfer printer of the present invention is capable of printing a plurality of images from one picture block of an ink sheet. The thermal transfer printer includes a damage prediction part that makes prediction of damage on a subsequent print image to be generated by printing of a preceding image by predicting damage on the ink sheet to be generated by printing of the preceding image, and a print control part that prints the preceding image while exerting control to suppress generation of the predicted damage on the subsequent print image based on the damage prediction.

According to the present invention, even if the preceding image to be printed is such an image that generates damage on the ink sheet, the damage prediction part predicts damage on the ink sheet, and the preceding image is printed while control is exerted to suppress generation of the predicted damage on the subsequent print image based on the damage prediction. As a result, generation of damage such as a printing crease in the subsequent print image can be suppressed.

These and other objects, features, aspects and advantages of the present invention will become more apparent from the following detailed description of the present invention when taken in conjunction with the accompanying drawings.

EMBODIMENT FOR CARRYING OUT THE INVENTION

First Preferred Embodiment

<Structure>

Figure 1:
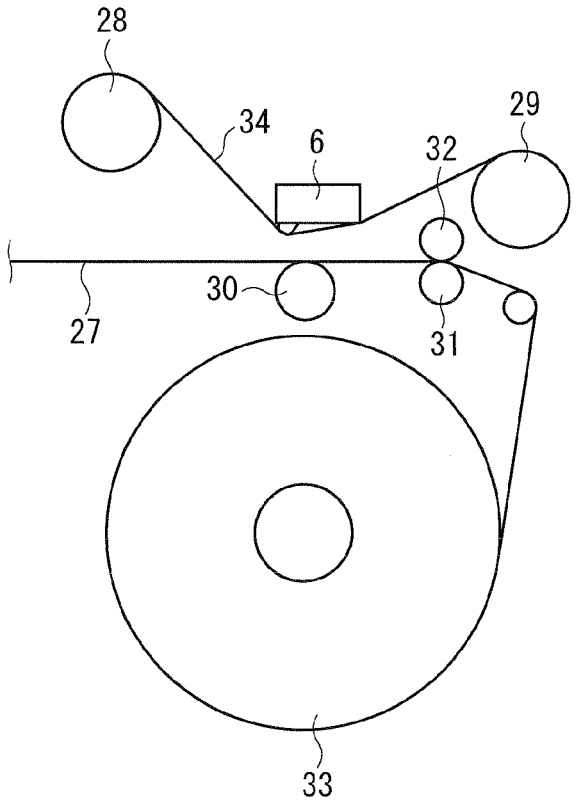
FIG. 1 shows the structure of a thermal transfer printer of a first preferred embodiment.

FIG. 1 shows the structure of a thermal transfer printer of a first preferred embodiment. An ink sheet 34 wound around ink bobbins 28 and 29, and a sheet of paper 27 wound around a paper roll 33, contact each other under pressure between a thermal head 6 and a platen roller 30. The thermal head 6 heats the ink sheet 34 to transfer ink applied to the ink sheet 34 onto the sheet of paper 27 being a target object of transfer. The sheet of paper 27 is conveyed by a grip roller 31 contacting a pinch roller 32 under pressure.

Figure 3:
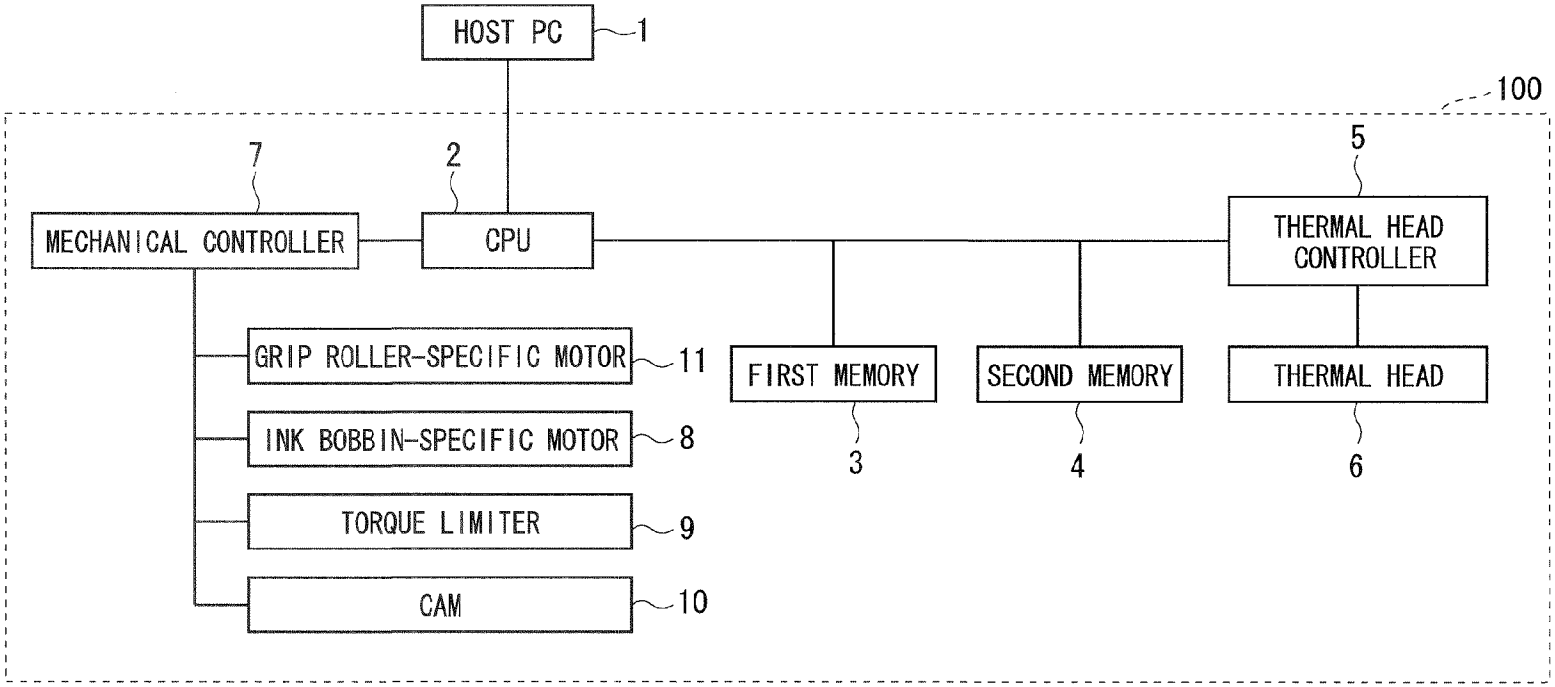
FIG. 3 is a functional block diagram of the thermal transfer printer of the first preferred embodiment.

The grip roller 31 is driven by a grip roller-specific motor 11 (FIG. 3). A cam 10 (FIG. 3) is provided in the thermal head 6. The thermal head 6 is placed at a fixed position that can be controlled in response to the angle of rotation of the cam 10.

Figure 2:
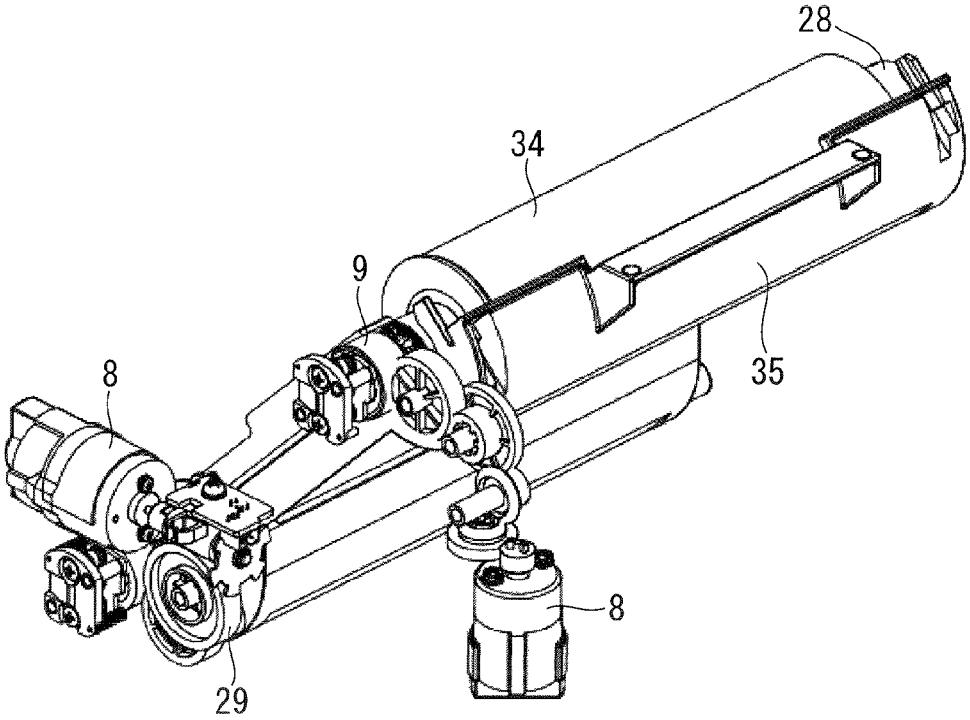
FIG. 2 shows a mechanism of conveying an ink sheet of the thermal transfer printer of the first preferred embodiment.

FIG. 2 shows a mechanism of conveying the ink sheet 34. The ink bobbins 28 and 29 are driven by an ink bobbin-specific motor 8. An ink cassette 35 housing the ink sheet 34 is attached to the ink bobbin 28 to feed the ink sheet 34. A torque limiter 9 that limits torque on the ink bobbin 28 is incorporated into a mechanism for driving the ink bobbin 28.

FIG. 3 is a functional block diagram of the thermal transfer printer of the first preferred embodiment. A host PC 1 is provided outside a printer 100 and is connected to the printer 100. The host PC 1 enters image data into the printer 100. A CPU 2 converts the image data entered into the printer 100 to print data, and stores the print data in a first memory 3. The CPU 2 also controls a thermal head controller 5 and a mechanical controller 7.

The thermal head controller 5 drives the thermal head 6 based on print data stored in the first memory 3 and a reference table stored in a second memory 4, thereby transferring ink on the ink sheet 34 onto the sheet of paper 27 being a target object of transfer. The first memory 3 is a hard disk drive or a DRAM, for example, and the second memory 4 is a flash ROM, for example.

The mechanical controller 7 controls the grip roller-specific motor 11 for driving the grip roller 31, the ink bobbin-specific motor 8 for driving the ink bobbins 28 and 29, the torque limiter 9 for limiting the rotational torque of the ink bobbin 28, and the cam 10 provided in the thermal head 6.

Figure 4:
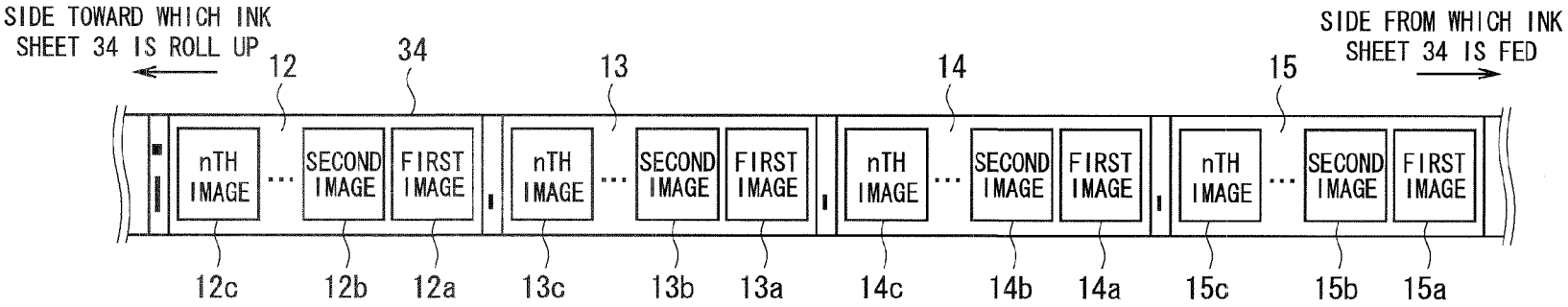
FIG. 4 shows regions of the ink sheet of the thermal transfer printer of the first preferred embodiment.

FIG. 4 shows the ink sheet 34 used to print a plurality of images. The ink sheet 34 is fed from the ink bobbin 28, and is rolled up by the ink bobbin 29. The ink sheet 34 is composed of a Y ink region 12 coated with ink of a Y color component, an M ink region 13 coated with ink of an M color component, a C ink region 14 coated with ink of a C color component, and an OP layer region 15 coated with an overcoat layer that are formed repeatedly in turn in this order when viewed from the side toward which the ink sheet 34 is rolled up. The Y, M and C ink regions 12, 13 and 14, and the OP layer region 15 form one group, and this group corresponds to one picture block. An ink sheet generally includes many such groups. To be specific, different picture blocks come before and after the picture block of the ink sheet 34 shown in FIG. 4.

The Y ink region 12 is composed of image regions including a first image 12*a*, a second image 12*b*, and an $n^{th}$ image 12*c*. The M and C ink regions 13 and 14, and the OP layer region 15 are composed in the same manner.

<Print Operation>

For transfer of an image onto the sheet of paper 27, while the ink sheet 34 being heated by the thermal head 6 contacts the sheet of paper 27 under pressure, the ink sheet 34 is rolled up and the sheet of paper 27 is conveyed by the grip roller 31, thereby transferring each line of the image. During the transfer, the thermal head controller 5 determines an energized period for the thermal head 6 based on print data stored in the first memory 3 and according to a reference table stored in the second memory 4. The print data is expressed in terms of the gradation value of image data separated into Y, M and C color components. The reference table contains the gradation value and the OD value (optical density value) of a transferred image in association with each other. The energized period for the thermal head 6 is determined based on the OD value. As an example, the energized period is made longer in response to the higher OD value. In this case, the ink sheet 34 is heated with heat of higher temperature, so ink is transferred more densely onto the sheet of paper 27. Conversely, for transfer of ink at a lower density, the energized period is made shorter.

In the description given below, printing of a first image means transfer of images of components of the first image, specifically first images 12*a*, 13*a*, 14*a* and 15*a* that are placed one above the other.

It is assumed that images including the first image and the $n^{th}$ image are printed sequentially by using the ink sheet 34 of FIG. 4. First, the ink sheet 34 is rolled up to find the beginning of the first image 12*a* in the Y ink region 12, and then the first image 12*a* is transferred onto the sheet of paper 27. Next, the ink sheet 34 is rolled up to find the beginning of the first image 13*a* in the M ink region 13, and then the first image 13*a* is transferred onto the sheet of paper 27 to cover the first image 12*a* from above. The ink sheet 34 is further rolled up to find the beginning of the first image 14*a* in the C ink region 14, and then the first image 14*a* is transferred onto the sheet of paper 27 to cover the first image 13*a* from above. The ink sheet 34 is further rolled up to find the beginning of the first image 15*a* in the OP layer region 15, and then the first image 15*a* is transferred onto the sheet of paper 27 to cover the first image 14*a* from above. As a result, printing of the first image is completed.

Next, the ink sheet 34 is rewound to find the beginning of the second image 12*b* in the Y ink region 12, and then the second image 12*b* is transferred. Then, like the printing of the first image, the second images 13*b* and 14*b* of the corresponding color components and the second image 15*b* are transferred, thereby completing printing of the second image. This operation is repeated until an $(n-1)^{th}$ image is printed. After printing of the $n^{th}$ image is completed, the ink sheet 34 is rolled up to find the beginning of a Y ink region of a next picture block without rewinding the ink sheet 34 to the side from which the ink sheet 34 is fed.

<Prediction of Damage on Ink Sheet>

Figure 5:
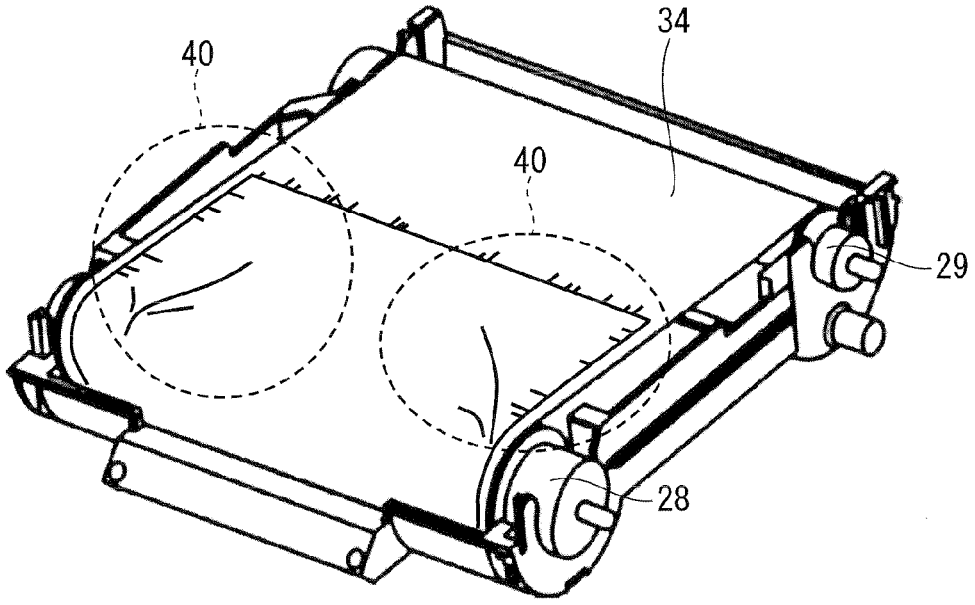
FIG. 5 shows creases generated in the ink sheet of the thermal transfer printer of the first preferred embodiment.

It is assumed for example that a print image is a high density blackish image so the ink sheet 34 is seriously damaged during printing. In this case, if a subsequent image is printed after the ink sheet 34 having been rolled up by the ink bobbin 29 is rewound toward the side to feed the ink sheet 34, ink sheet creases 40 are generated in the ink sheet 34 while the ink sheet 34 is rewound toward the side to feed the ink sheet 34 as shown in FIG. 5. As a result, printing damage such as a printing crease may be generated with high probability on a surface of a printed matter while the subsequent image is printed. The ink sheet 34 may fracture if the ink sheet 34 is damaged seriously. This may make it impossible to print the subsequent image.

In response, in the thermal transfer printer of the first preferred embodiment, the host PC 1 predicts damage on a subsequent print image to be generated due to damage on the ink sheet 34 generated by printing of a preceding image, specifically, predicts damage on the ink sheet 34. If the host PC 1 predicts that printing of the preceding image will damage the subsequent print image seriously, specifically, that damage will be generated, the thermal transfer printer exerts control to suppress generation of a printing crease in the subsequent print image.

A damage prediction part that predicts damage on the ink sheet 34 is described next. The first preferred embodiment employs a technique disclosed in Japanese Patent Application Laid-Open No. 2007-90798 as the damage prediction part. This technique predicts damage based on the averages of gradation values of a preceding image.

With reference to FIG. 4, it is assumed that the first image is an image to be printed earlier. In this case, the second image is an image to be printed subsequently. First, print data about the first image, specifically data about the gradation values of the C, M and Y components of the first image, are retrieved from the first memory 3. Next, the average of gradation values of each color component is calculated, and the threshold of the average gradation value is set at 200, for example. Then, it is determined that damage will be generated if any one of the Y, M and C image components has an average gradation value of 200 or higher. If it is determined that damage will be generated, the first image, namely, the preceding image is printed while control is exerted to suppress generation of a printing crease in the subsequent print image. It is determined that damage will not be generated if each of the color components has an average gradation value of lower than the threshold. In this case, the first image is printed according to general procedure.

After the first image is printed, the ink sheet 34 is rewound to find the image 12*b* of the Y component of the second image. Before the second image is printed, prediction about damage is made by following the same way as that of the first image. Then, the second image is printed while control is exerted in response to a result of the damage prediction. This process is repeated until the $n^{th}$ image is printed.

In addition to the aforementioned averages of gradation values of the preceding image, a distribution of high density regions of the preceding image may be used to make prediction about damage. In this case, images of the Y, M and C components of the preceding image are allocated to properly divided areas, and the average of gradations is calculated for each of the areas. If high density areas having averages higher than a predetermined threshold are distributed densely so they are out of range of given standards, it is determined that damage will be generated.

This way predicts damage by dividing an image into areas finely compared to the way of calculating the average gradation value of each of the entire image component, so that it is considered to be more preferable if employed in printing using an ink sheet that is susceptible to damage more easily than a generally used ink sheet.

The aforementioned way of predicting damage may reflect ambient temperature, humidity, data about the winding position of the ink sheet 34, and information about the ink sheet 34 (described later). As an example, if ambient temperature is higher than normal temperature, the ink sheet 34 is susceptible to damage more easily than in the normal temperature. So, the aforementioned threshold is made lower. The data about the winding position of the ink sheet 34 indicates a position to which the ink sheet 34 is rolled up. This data is usable in determining the winding diameters of the ink bobbins 28 and 29. Generally, tension applied to an ink sheet changes in response to the winding diameter of an ink bobbin. So, damage can be predicted properly by adjusting the aforementioned threshold in response to the winding diameter.

Figure 6:
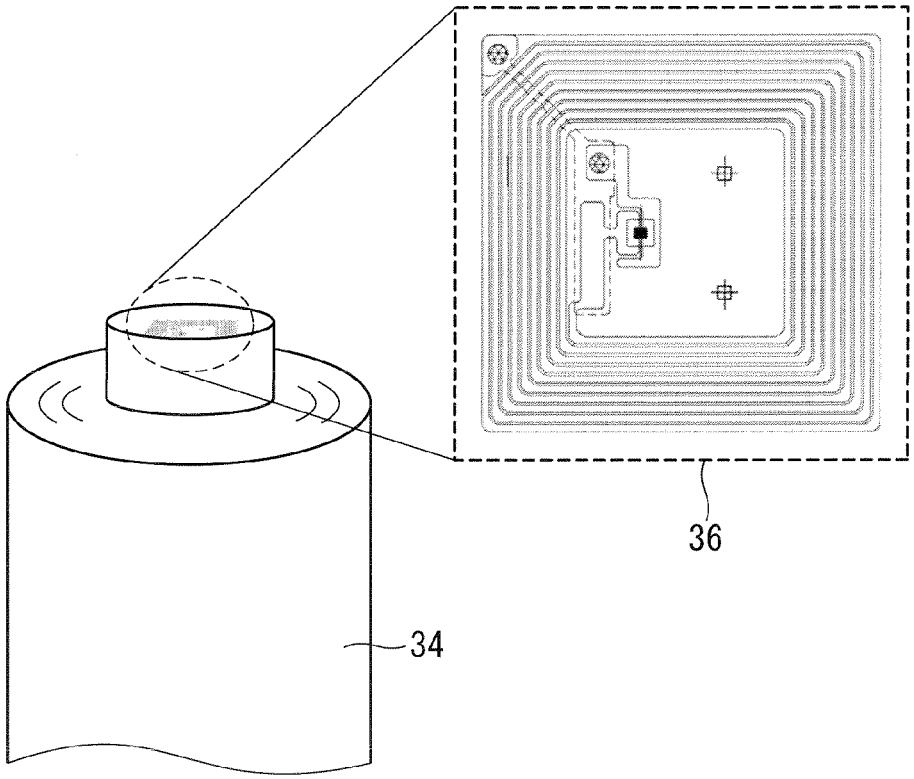
FIG. 6 shows an IC tag of the thermal transfer printer of the first preferred embodiment.

The information about the ink sheet 34 is information about the heat resistance of the ink sheet 34, for example. Damage prediction can reflect the characteristics of the ink sheet 34 if this information is stored in advance in an IC tag 36, and is read from the IC tag 36 placed on the axis of rotation of the ink sheet 34 as shown in FIG. 6. As an example, if an ink sheet to be used has heat resistance higher than that of a generally used ink sheet, the aforementioned threshold may be set higher than is generally assumed. This prevents damage prediction to a degree greater than necessary.

The host PC 1 makes damage prediction in the first preferred embodiment. Alternatively, the CPU 2 of the printer 100 may make damage prediction.

<Print Control Part>

The thermal transfer printer of the first preferred embodiment includes a print control part that suppresses generation of a printing crease in a subsequent print image based on the aforementioned damage prediction. The print control part includes a print speed controller that controls a print speed.

The print speed controller realizes printing at a speed lower than is generally assumed. The mechanical controller 7 exerts control to reduce the speed of rotation of the grip roller-specific motor 11 for driving the grip roller 31, thereby realizing the print speed controller. If the aforementioned damage prediction part determines that damage will be generated, the print speed controller prints a preceding image at a speed lower than is generally assumed.

<Effects>

The thermal transfer printer of the first preferred embodiment is capable of printing a plurality of images from one picture block of the ink sheet 34. The thermal transfer printer includes the damage prediction part and the print control part. The damage prediction part makes prediction of damage on a subsequent print image to be generated by printing of a preceding image by predicting damage on the ink sheet 34 to be generated by printing of the preceding image. The print control part prints the preceding image while exerting control to suppress generation of the predicted damage on the subsequent print image based on the damage prediction.

So, if the damage prediction part determines that damage will be generated on the ink sheet 34, the print control part suppresses generation of damage such as a printing crease in the subsequent print image.

The print control part of the thermal transfer printer of the first preferred embodiment includes the print speed controller that controls a print speed. So, if the damage prediction part determines that damage will be generated on the ink sheet 34, the print speed controller prints the preceding image at a low speed, making it possible to suppress generation of damage such as a printing crease in the subsequent print image at low costs.

Second Preferred Embodiment

Like that of the first preferred embodiment, a thermal transfer printer of a second preferred embodiment includes a damage prediction part and a print control part. The structure, the basic print operation, and the damage prediction part of the thermal transfer printer of the second preferred embodiment are the same as those of the first preferred embodiment, so they will not be described again. In the second preferred embodiment, the print control part includes a print density controller that controls the density of a print image.

Figure 7:
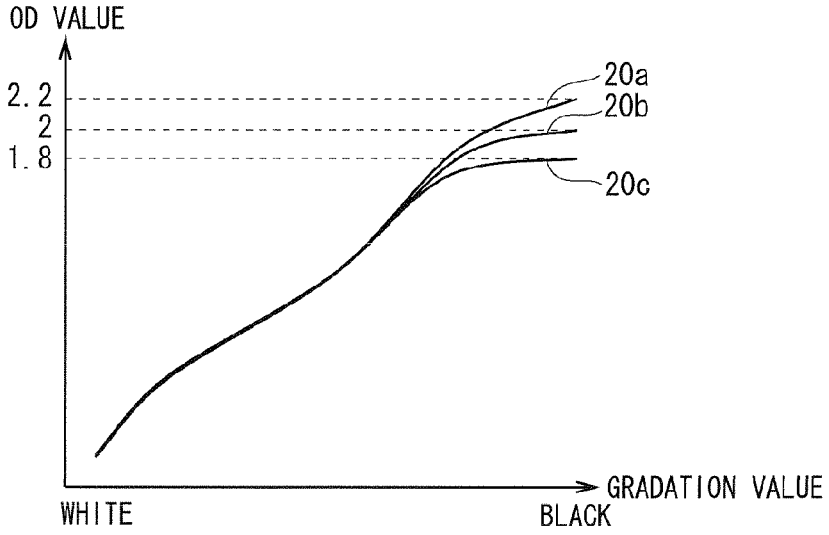
FIG. 7 shows density control performed in a thermal transfer printer of a second preferred embodiment.

A print density is controlled by changing a reference table shown in FIG. 7. As is already described above, the reference table contains the gradation value of print data and the density of a print image in association with each other. It is assumed that the reference table generally determines the OD value based on a curve 20*a*. If the damage prediction part determines that damage will be generated, the print density controller changes the basis of the reference table to a curve 20*b* or 20*c*, thereby lowering the maximum of the OD value of a print image. To be specific, the print density controller prints a preceding image while lowering the print density of part having a particularly high density of image data of the preceding image.

A print density is lowered not only in the aforementioned way but it may also be lowered by multiplying the gradation value of image data by a proper coefficient. As an example, gradation data stored as print data in the first memory 3 is multiplied by a proper coefficient such as 0.9, and resultant gradation data is used as new print data. As a result, the density of an entire print image can be lowered.

<Effects>

The print control part of the thermal transfer printer of the second preferred embodiment includes the print density controller that controls a print density. The print density controller makes the print density of a preceding image lower than is generally assumed. As a result, like in the first preferred embodiment, generation of damage such as a printing crease in a subsequent print image can be suppressed.

Third Preferred Embodiment

Like that of the first preferred embodiment, a thermal transfer printer of a third preferred embodiment includes a damage prediction part and a print control part. The structure, the basic print operation, and the damage prediction part of the thermal transfer printer of the third preferred embodiment are the same as those of the first preferred embodiment, so they will not be described again. In the third preferred embodiment, the print control part includes a tension controller that controls tension on the ink sheet 34.

The ink sheet 34 receives tension applied to part thereof extending between the ink bobbin 29 toward which the ink sheet 34 is rolled up and the thermal head 6, and tension applied to part thereof extending between the thermal head 6 and the ink bobbin 28 to feed the ink sheet 34. In the instant specification, tensions applied to these parts are called roll-up tension and feed tension respectively. In the instant specification, "tension" is an inclusive word for the roll-up and feed tensions.

It is generally known that a printing crease is generated easily in a print image if the image is printed while the ink sheet 34 is placed under high tension. The ink sheet 34 in this condition may fracture if it is used for printing.

As described in the first preferred embodiment, the ink sheet 34 is conveyed by the ink bobbins 28 and 29, and the ink bobbins 28 and 29 are each driven by the ink bobbin-specific motor 8. The ink bobbin-specific motor 8 may be a DC motor, for example.

The tension on the ink sheet 34 can be adjusted dynamically by PWM (pulse width modulation) controlling the ink bobbin-specific motor 8. The tension on the ink sheet 34 can also be adjusted dynamically by switching a mechanism for driving the ink bobbin 28 by driving the ink bobbin 28 through the torque limiter 9. The torque limiter 9 may also be provided to a mechanism for driving the ink bobbin 29, for example. In this case, a plurality of torque limiters 9 is provided to switch driving mechanisms, making it possible to adjust tension more finely. In the third preferred embodiment, if the damage prediction part determines that damage will be generated, a preceding image is printed while tension on the ink sheet 34 is made lower than is generally assumed.

<Effects>

The print control part of the thermal transfer printer of the third preferred embodiment includes the tension controller that controls tension on the ink sheet 34. The tension controller makes tension on the ink sheet 34 lower than is generally assumed. As a result, like in the first preferred embodiment, generation of damage such as a printing crease in a subsequent print image can be suppressed.

Fourth Preferred Embodiment

Like that of the first preferred embodiment, a thermal transfer printer of a fourth preferred embodiment includes a damage prediction part and a print control part. The structure, the basic print operation, and the damage prediction part of the thermal transfer printer of the fourth preferred embodiment are the same as those of the first preferred embodiment, so they will not be described again. In the fourth preferred embodiment, the print control part includes a pressure controller that controls pressure of the thermal head 6. It is described next how pressure of the thermal head 6 is controlled.

As described in the first preferred embodiment, the cam 10 is provided in the thermal head 6. In response to rotation of the cam 10, the fixed position of the thermal head 6 is changed, thereby changing pressure applied between the thermal head 6 and the platen roller 30. Generally, reducing pressure of the thermal head 6 makes damage on the ink sheet 34 less likely, specifically, makes generation of a printing crease less likely. However, reducing pressure of the thermal head 6 in turn reduces adhesive force acting between the ink sheet 34 and the sheet of paper 27, so a printing blur may be generated easily.

In the fourth preferred embodiment, if the damage prediction part determines that damage will be generated, a preceding image is printed while pressure of the thermal head 6 is made lower than is generally assumed. At this time, it is desirable that pressure of the thermal head 6 be controlled to fall within a range that does not generate the aforementioned printing blur.

<Effects>

The print control part of the thermal transfer printer of the fourth preferred embodiment includes the pressure controller that controls pressure of the thermal head 6. The pressure controller makes pressure of the thermal head 6 lower than is generally assumed. As a result, like in the first preferred embodiment, generation of damage such as a printing crease in a subsequent print image can be suppressed.

Fifth Preferred Embodiment

In a fifth preferred embodiment, printing is controlled in response to the type of the ink sheet 34 by the print speed controller, the print density controller, the tension controller, or the pressure controller described in the first to fourth preferred embodiments. As an example, the type of the ink sheet 34 means the characteristics of the ink sheet 34 that vary according to manufactures of the ink sheet 34. The type of the ink sheet 34 also means the type of ink applied to the ink sheet 34, or size variations of the ink sheet 34, for example. It is assumed for example that reducing tension on the ink sheet 34 to be used for printing is not preferred depending on the characteristics of the ink sheet 34. In this case, printing is made while generation of damage on the ink sheet 34 is suppressed not only by the tension controller, but by the print speed controller, the print density controller, or the pressure controller. Printing may be controlled by a combination of the print speed controller, the print density controller, the tension controller, and the pressure controller.

<Effects>

The print control part of the fifth preferred embodiment exerts control in response to the type of the ink sheet 34. An appropriate controller controls printing in response to the type of the ink sheet 34. As a result, generation of damage such as a printing crease in a subsequent print image can be suppressed.

The preferred embodiments of the present invention can be combined freely, and each of the preferred embodiments can be modified or omitted where appropriate without departing from the scope of the invention.

While the invention has been shown and described in detail, the foregoing description is in all aspects illustrative and not restrictive. It is therefore understood that numerous modifications and variations can be devised without departing from the scope of the invention.

What is claimed is:

1. A thermal transfer printer capable of printing a plurality of images from one picture block of an ink sheet, comprising a damage prediction part that determines a damage prediction on a section of said ink sheet that is used for the printing of a preceding image, and a print control part that controls a printing operation using said determined damage prediction so as to suppress generation of damage on a subsequent print image caused by the printing of said preceding image, when said preceding image is printed by using a section of said ink sheet on which said damage prediction is made, wherein prior to the printing of said preceding image, said damage prediction part predicts whether damage on said ink sheet is generated or not if said preceding image is printed, in a case where said damage prediction part determines that damage on said ink sheet is generated, said print control part controls the printing operation using said determined damage prediction so as to suppress generation of damage on said subsequent print image caused by the printing of said preceding image, when said preceding image is actually printed by using a section of said ink sheet on which said damage prediction is made, and said preceding image and said subsequent image are printed by using a same picture block of said ink sheet, and an arrangement order of said preceding image and said subsequent image along longitudinal direction in said same picture block of said ink sheet is not changed by said damage prediction.

2. The thermal transfer printer according to claim 1, wherein said print control part includes a print speed controller that controls a print speed.

3. The thermal transfer printer according to claim 1, wherein said print control part includes a print density controller that controls a print density.

4. The thermal transfer printer according to claim 1, wherein said print control part includes a tension controller that controls tension on said ink sheet.

5. The thermal transfer printer according to claim 1, wherein said print control part includes a pressure controller that controls pressure of a thermal head on said ink sheet.

6. The thermal transfer printer according to claim 1, wherein said print control part exerts control in response to the type of said ink sheet.

* * * * *